US006009576A

United States Patent [19]

Gramme et al.

[11] Patent Number: 6,009,576

[45] Date of Patent: Jan. 4, 2000

[54] BODY-CONFORMING WRAPPING ARTICLE FOR INFANTS

[76] Inventors: Daniel Louis Gramme; Danna June Gramme, both of 3238 Nebraska Pl., Costa Mesa, Calif. 92626

[21] Appl. No.: 09/134,973

[22] Filed: Aug. 17, 1998

[51] Int. Cl.[7] ..... A47C 9/06; A41B 13/06

[52] U.S. Cl. ..... 5/413 R; 5/655; 2/69

[58] Field of Search ..... 5/413 R, 494, 5/655; 2/69, 69.5

[56] References Cited

U.S. PATENT DOCUMENTS

| | | | |
|---|---|---|---|
| 1,678,125 | 6/1928 | Petrescu | 5/413 R |
| 2,227,751 | 1/1941 | Idelman | 5/494 X |
| 2,538,420 | 1/1951 | Junghans | 2/69.5 X |
| 4,897,885 | 2/1990 | Lunt | 2/69.5 |
| 4,979,250 | 12/1990 | Troncone et al. | 5/494 |
| 5,692,257 | 12/1997 | Albertieri | 5/494 X |

*Primary Examiner*—Michael F. Trettel
*Attorney, Agent, or Firm*—Gary Appel

[57] ABSTRACT

A body-conforming, securing wrapping article for infants comprises a generally T-shaped piece of fabric material having a securing central, infant-receiving portion with sidewardly-extending right-hand and left-hand wrapping flaps, a securing downwardly-extending lower wrapping flap, and an infant headrest region extending upwardly in the plane of the securing central portion, at least part of the securing central portion being formed having a plurality of spaced apart elastically gathered transverse regions and including mating hook and loop strips on the right-hand and left-hand flaps for maintaining the flaps in a folded condition over the folded up securing lower flap to enclose and conform to an infant received on the securing central portion of the article.

8 Claims, 3 Drawing Sheets

BODY-CONFORMING WRAPPING ARTICLE FOR INFANTS

BACKGROUND OF THE INVENTION

1. Field of the Invention

The present invention relates generally to the field of infant clothing, and still more particularly to a wrapping article or "bunting" for infants, especially young babies.

2. Background Discussion

It is, of course, generally known that newly-born and young babies or infants are generally wrapped or "swaddled" in small, baby blankets or similar articles to keep the babies warm and contented, and to provide a protective padding against injury to the baby.

U.S. patents covering various types of such swaddling and protective baby wraps are known. These include U.S. Pat. No. 5,722,094, to Ruefer, issued Mar. 3, 1998, which discloses an infant swaddling apparatus. This apparatus forms a pouch which may be wrapped and secured with hook-and-loop fasteners. U.S. Pat. No. 5,058,226, to Crosby, issued Oct. 22, 1991, discloses a newborn car seat blanket, having a two-legged pouch to receive a baby's legs. U.S. Pat. No. 5,046,204, to Mohler, issued Sep. 10, 1991, discloses an infant wrapping article, having hook-and-loop fasteners, a hood, and separate leg pouches.

Other known U.S. patents are U.S. Pat. No. 4,986,458, to Linday, issued Jan. 22, 1991, which discloses an infant carrier in which a pouch is attached to a harness for carrying an infant; U.S. Pat. No. 4,901,371, to Christians, issued Feb. 20, 1990, discloses an infant bag garment for use in a car seat, the garment having separate arm sleeves and leg pouches; U.S. Pat. No. 4,897,885, to Lunt, issued Feb. 6, 1990, which discloses a one-piece infant bunting which folds flat, with hook-and-loop fasteners to hold the bunting around the baby in a wrap.

Still other known U.S. patents are U.S. Pat. No. 4,611,353, to Als et al., issued Sep. 16, 1986, which discloses an infant garment in which an infant is placed in a sack portion and then wrapped with two flaps that may hold by themselves or be augmented with hook-and-loop fasteners; U.S. Pat. No. 5,621,917, to Howsen, issued Apr. 22, 1997, which discloses an infant care garment, which garment forms a loose sack closed with hook and loop fastener and having sleeves for an infant's arms; U.S. Pat. No. 5,129,406, to Magnusen et al., issued Jul. 14, 1992, which discloses a baby straight-jacket for drug-addicted infants, the infant's arms are wrapped in a traditional straight-jacket manner, while the torso and legs may be optionally enclosed in the attached sack; and U.S. Pat. No. 5,611,095, to Schneider, issued Mar. 18, 1997, which discloses a multi-function baby wrap, that is not illustrated in use, but rather in flat, laid-out form.

For various reasons which will become apparent from the following description, the present inventor considers that his infant wrapping device provides patentable improvements over such known infant wrapping devices.

SUMMARY OF THE INVENTION

In accordance with the present invention, there is provided a body-conforming, secure wrapping article for infants. The article comprises a generally T-shaped piece of fabric material having a security central, infant-receiving portion with sidewardly-extending right-hand and left-hand wrapping flaps and a security downwardly-extending lower wrapping flap. The central portion is formed having at least one, and preferably three, elastically gathered transverse regions.

Included are mating hook and loop strips on the right-hand and left-hand flaps for maintaining the flaps in a folded condition over the folded up lower flap and over an infant resting on the security central portion, the elastically gathered regions enabling the article to secure the baby by closely conforming to the infant's body.

Preferably, there is included an infant headrest region extending upwardly from and in the plane of the central portion. Also preferably, the article is formed from at least one layer of a soft cotton, flannel material.

BRIEF DESCRIPTION OF THE DRAWINGS

The present invention can be more readily understood by a consideration of the following detailed description when taken in conjunction with the accompanying drawings, in which.

In the various FIGS., the same elements and features are given the same reference numbers.

DESCRIPTION OF THE PREFERRED EMBODIMENT

Figure 1:
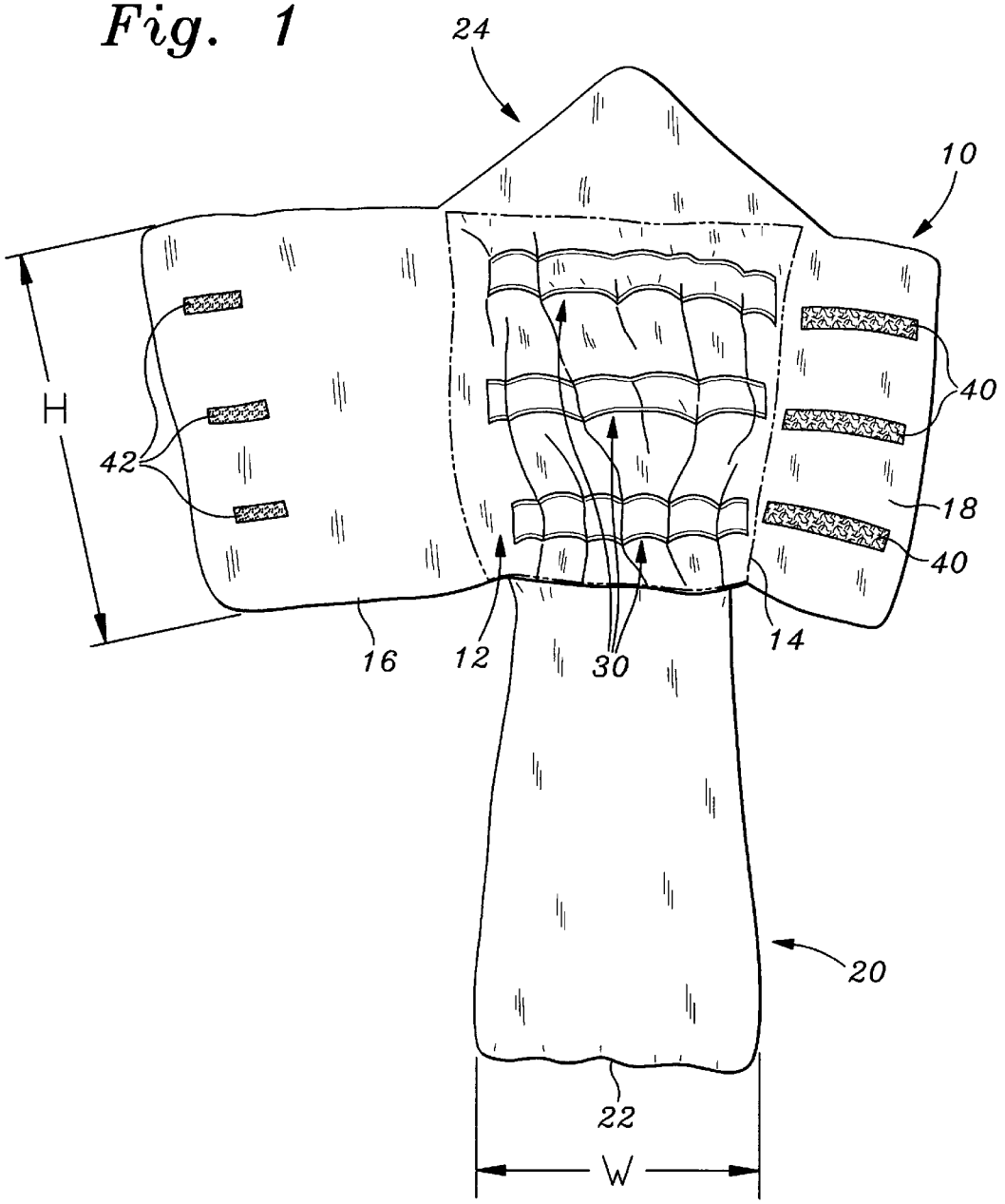
FIG. 1 is a plan view of the cloth, body-conforming, infant wrapping article in a flat, unwrapped or fully opened condition showing a securing central portion having connected to or extending from respective right-hand and left-hand side regions, wide right-hand and left-hand wrapping flaps having mating hook and loop fastening strips, and connected to or extending from a lower region an elongate securing lower wrapping flap, and further showing several elastically-gathered seams transversely sewn across the securing central portion.

There is shown in FIG. 1 a body-conforming, infant wrapping article 10, which is shown in its flat, unwrapped or fully opened condition.

Although article 10 is constructed as a generally T-shaped, one piece article, the article can best be described in terms of its various portions or regions. Thus, article 10 can be considered as comprising generally a rectangular securing central portion or region 12 shown outlined in phantom lines. This securing central portion 12 may further have at its upper edge an elastic gathering to thus secure the wrapping article more closely around the infant.

Extending sidewardly of the right-hand edge of securing central portion 12 and in the plane of the securing central portion is a generally rectangular right-hand wrapping flap 16. Similarly, extending sidewardly of the left-hand edge of securing central portion 12 and in the plane of the central portion is a generally rectangular left-hand wrapping flap 18. Both flaps 16 and 18 have a height, H, about equal to the height of securing central portion 12. For reasons to become apparent, right-hand flap 16 is substantially longer (i.e., wider) than left-hand flap 18.

Depending from a lower edge and in the plane of securing central portion 12 is an elongate securing lower flap 20. As depicted in FIG. 1, the securing lower flap is somewhat tapered (widening downwardly) so that at its lower edge 22 its width, W, is about the same as that of securing central portion 12. In a variation, the securing lower flap may be eliminated and replaced by an elastically gathered lower edging 30*a* (FIG. 4) or drawstring 50 (FIG. 5) to secure and retain the infant with or without the need for the securing lower flap.

Figure 5:
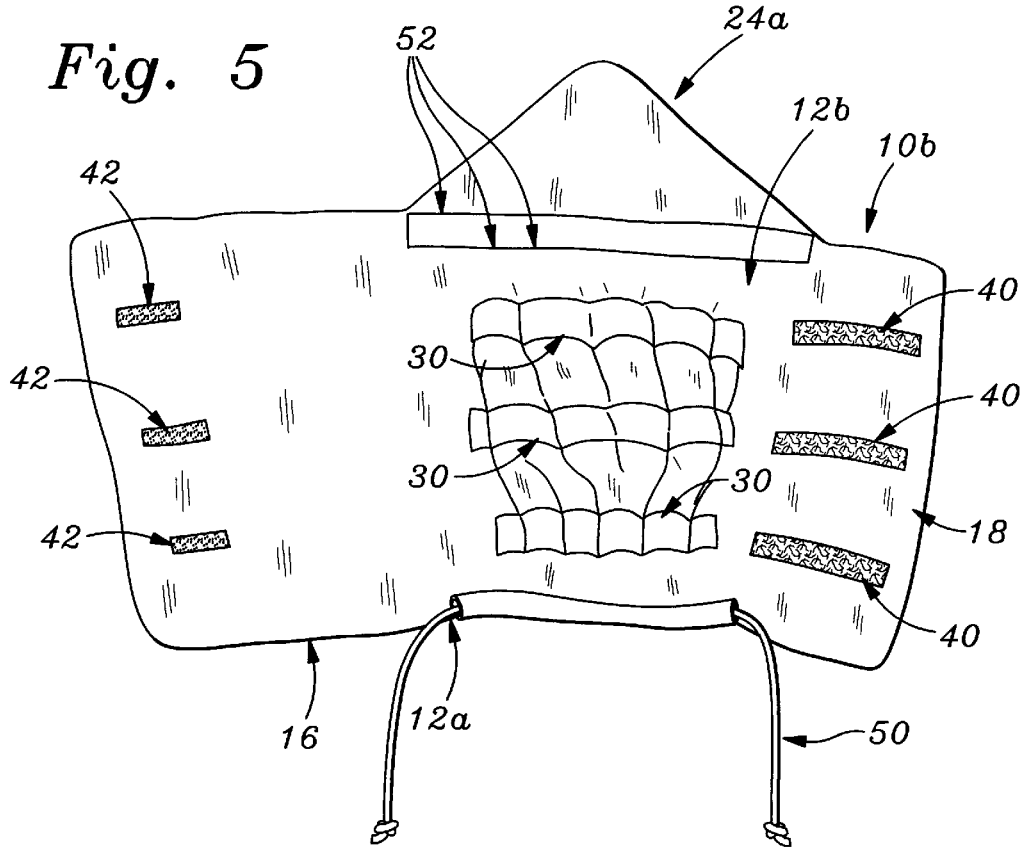
FIG. 5 is a plan view of another variation of the infant wrapping article of FIG. 1, showing the infant headrest or head support detachably attached to the central portion by hook and loop fasteners and showing a drawstring at a lower edge of the central portion, with the lower flap eliminated.

A generally triangular infant headrest or head support portion 24 extends from an upper edge and in the plane of central portion 12. The infant head rest 24*a* (FIG. 5), in another variation, can be made detachable for use with or without the headrest support which is detachably secured by hook and loop fasteners 52 (FIG. 5).

Figure 4:
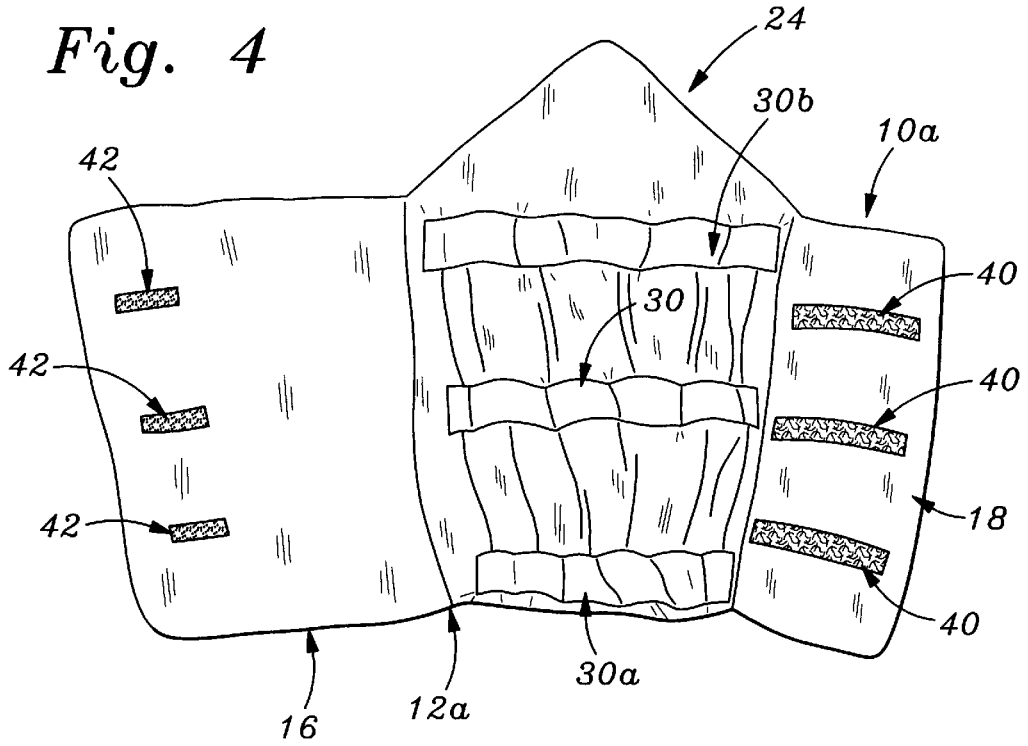
FIG. 4 is a plan view of a variation of the infant wrapping article of FIG. 1, showing a transverse elastically-gathered seam along an upper edge region and along a lower edge of the central portion of the article, with the lower flap eliminated.

Importantly, to enable firm conforming of article 10 to a wrapped infant's body and thus keep the article securely in place, at least one and preferably three (as shown in FIG. 1) elastically-gathered regions 30 are formed transversely in partial or complete rows across at least part of securing central portion 12 one of which (30*b*) may be located along the upper edge of the central portion as shown in FIG. 4.

For the three elastically-gathered regions 30 shown, the regions are about equally spaced apart from top to bottom of securing central portion 12. Consequently, in the wrapping procedure described below, securing central portion 12 is stretched so that article 10 closely secures the infant by conforming to the infant's body. This assures that the wrapped infant will be kept very secure and warm, and also confines the infant's hands to prevent the wrapped infant from scratching and thus injuring its eyes.

Article 10 may be constructed of one or more layers of soft fabric, for example, cotton flannel.

Figure 2:
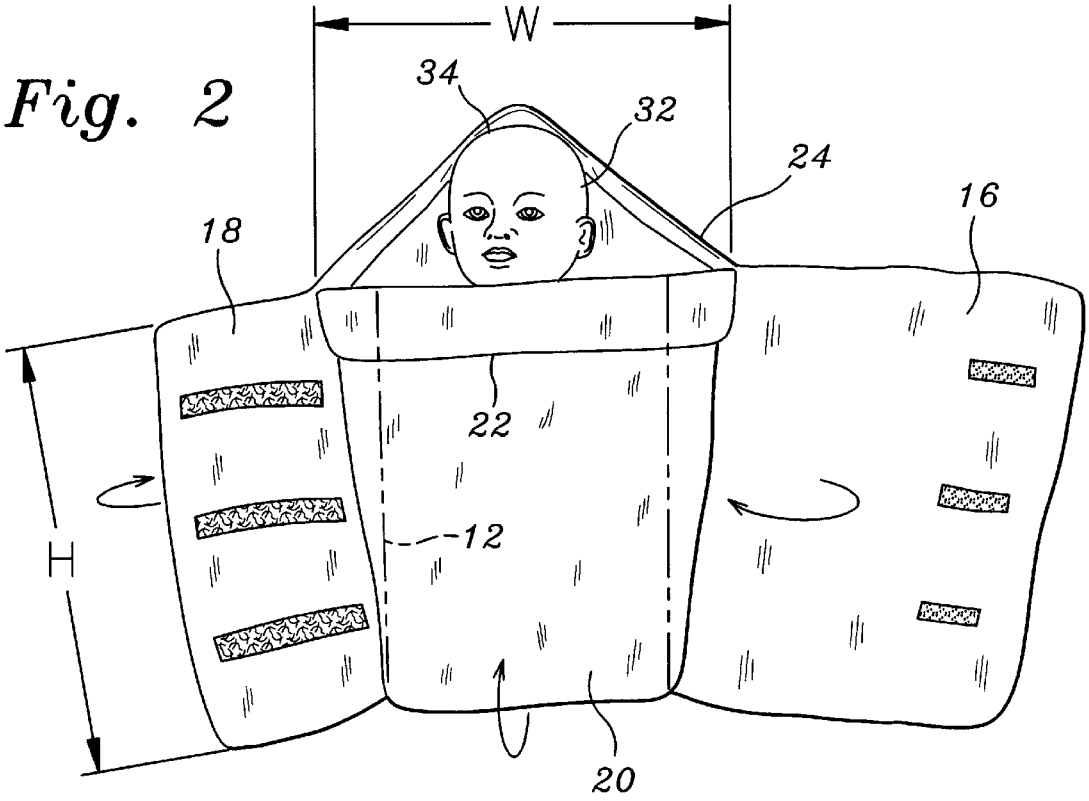
FIG. 2 is a plan view similar to FIG. 1, except that an infant is shown resting on its back on the securing central portion of the article, and that the securing lower flap is shown folded up over the infant's body, the right-hand and left hand flaps being shown in their flat, unfolded condition.
Figure 3:
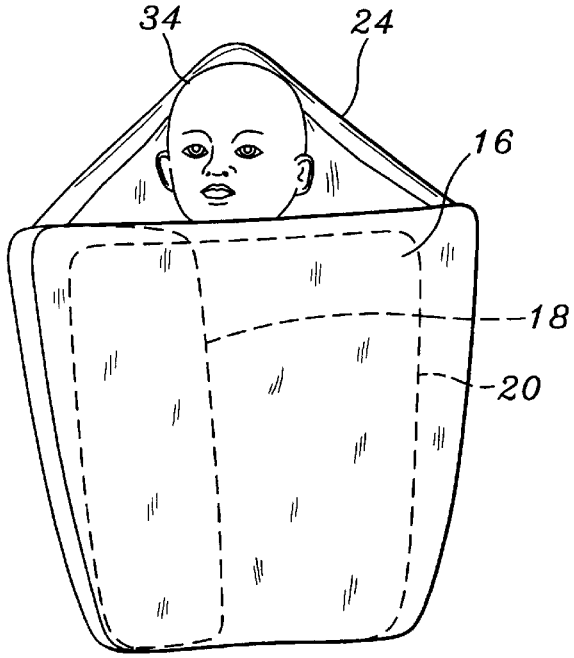
FIG. 3 is a plan view similar to FIG. 2, except that in this figure the right-hand and left-hand flaps are shown folded over the securing folded up lower flap, with the right-hand flap being shown on top, and the two side flaps being shown secured to one another by engagement of the mating hook and loop strips.

In use, an infant 32 (FIGS. 2 and 3) is placed on securing central portion 12 with its head 34 resting on support portion 24. Securing lower flap 20 is then folded up and over the infant's body. Securing lower flap 20 may be made sufficiently long to enable lower edge 22 thereof to be folded over a short amount under infant's head 34.

Next, left-hand flap 18 is folded up and over lower flap 20, and finally, right-hand flap 16 is folded up and over the left-hand flap. Hook and loop fastener strips 40 and 42 are sewn in appropriate overlapping regions of the two side flaps 16 and 18 to keep the conforming wrapping in place.

Although there has been described above a body-conforming, secure wrapping article for infants in accordance with the present invention for purposes of illustrating the manner in which the present invention may be used to advantage, it is to be understood that the invention is not limited thereto. Consequently, any and all variations and equivalent arrangements which may occur to those skilled in the applicable art are to be considered to be within the scope and spirit of the invention as set forth in the claims which are appended hereto as part of this application.

What is claimed is:

1. A body conforming, secure wrapping article for infants which comprises a generally T-shaped piece of fabric material having a securing central, infant-receiving portion with sidewardly-extending right-hand and left-hand wrapping flaps and a downwardly-extending lower wrapping flap, said securing central portion being formed having at least one elastically gathered transverse region, and including means on said right-hand and left-hand flaps for maintaining said flaps in a folded condition over an infant received on said securing central portion, including an infant headrest region extending upwardly in the plane of the central portion said headrest being detachably connected to said central portion.

2. A body conforming, secure wrapping article for infants which comprises a generally T-shaped piece of fabric material having a securing central, infant-receiving portion with sidewardly-extending right-hand and left-hand wrapping flaps and a downwardly-extending lower wrapping flap, said securing central portion being formed having three spaced apart, elastically gathered transverse regions, and including means on said right-hand and left-hand flaps for maintaining said flaps in a folded condition over an infant received on said securing central portion.

3. A body conforming, secure wrapping article for infants which comprises a generally T-shaped piece of fabric material having a securing central, infant-receiving portion with sidewardly-extending right-hand and left-hand wrapping flaps, said securing central portion being formed having an elastically gathered transverse region along the central portion lower edge length to further conform to and secure the infant, and including means on said right-hand and left-hand flaps for maintaining said flaps in a folded condition over an infant received on said securing central portion.

4. A body conforming, secure wrapping article for infants which comprises a generally T-shaped piece of fabric material having a securing central, infant-receiving portion with sidewardly-extending right-hand and left-hand wrapping flaps, said securing central portion being formed having at least one elastically gathered transverse region and a drawstring along its lower edge length to further conform to and secure the infant, and including means on said right-hand and left-hand flaps for maintaining said flaps in a folded condition over an infant received on said securing central portion.

5. A body conforming, secure wrapping article for infants which comprises a generally T-shaped piece of fabric material having a securing central, infant-receiving portion with sidewardly-extending right-hand and left-hand wrapping flaps and a downwardly-extending lower wrapping flap, said securing central portion being formed having an elastically gathered transverse region along its lower edge length and at least one elastic region located along the upper edge of said central portion, and including means on said right-hand and left-hand flaps for maintaining said flaps in a folded condition over an infant received on said securing central portion.

6. A body-conforming, securing wrapping article for infants which comprises a generally T-shaped piece of fabric material having a central, infant-receiving portion with sidewardly-extending right-hand and securing left-hand wrapping flaps, a downwardly-extending lower wrapping flap, and an infant headrest region extending upwardly in the plane of the central portion, said securing central portion being formed having three spaced apart elastically gathered regions and including mating hook and loop strips on said right-hand and left-hand flaps for maintaining said flaps in a folded condition over an infant received on said securing central portion.

7. A body-conforming, securing wrapping article for infants which comprises a generally T-shaped piece of fabric material having a central, infant-receiving portion with sidewardly-extending right-hand and securing left-hand wrapping flaps, a downwardly-extending lower wrapping flap, and an infant headrest region extending upwardly in the plane of the central portion, said securing central portion being formed having an elastically gathered region along its lower edge to further conform to and secure the infant, and including mating hook and loop strips on said right-hand and left-hand flaps for maintaining said flaps in a folded condition over an infant received on said securing central portion.

8. A body-conforming, securing wrapping article for infants which comprises a generally T-shaped piece of fabric material having a central, infant-receiving portion with sidewardly-extending right-hand and securing left-hand wrapping flaps, a downwardly-extending lower wrapping flap, and an infant headrest region extending upwardly in the plane of the central portion, said securing central portion being formed having at least one elastically gathered transverse region and including a drawstring along its lower edge length to further conform to and secure the infant, and including mating hook and loop strips on said right-hand and left-hand flaps for maintaining said flaps in a folded condition over an infant received on said securing central portion.

* * * * *